US007021306B1

(12) United States Patent
Billings

(10) Patent No.: US 7,021,306 B1
(45) Date of Patent: Apr. 4, 2006

(54) STONE CUTTING SYSTEM

(75) Inventor: Lanny D. Billings, Bagley, MN (US)

(73) Assignee: Steven A. Crandall, Bagley, MI (US)

( * ) Notice: Subject to any disclaimer, the term of this patent is extended or adjusted under 35 U.S.C. 154(b) by 0 days.

(21) Appl. No.: 10/757,001

(22) Filed: Jan. 13, 2004

(51) Int. Cl.
*B28D 1/04* (2006.01)

(52) U.S. Cl. ..... 125/13.01; 451/365

(58) Field of Classification Search ..... 125/13.01, 125/13.03, 35, 15, 12; 451/41, 390, 365, 451/364
See application file for complete search history.

(56) References Cited

U.S. PATENT DOCUMENTS 2,056,491 A * 10/1936 Stimson ..... 451/365
2,431,469 A * 11/1947 Eyles ..... 125/13.01
2,515,331 A * 7/1950 Bond ..... 125/35
2,909,169 A * 10/1959 Vonada ..... 125/13.01
3,815,570 A * 6/1974 Story ..... 125/14
4,520,880 A 6/1985 Saito ..... 175/51
6,263,866 B1 7/2001 Tsao ..... 125/13.01

FOREIGN PATENT DOCUMENTS

FR 64771 * 10/1864 ..... 125/13.01
FR 2706348 * 12/1994 ..... 125/13.01
JP 56-33262 * 4/1981 ..... 451/41

OTHER PUBLICATIONS

Porta Cut Stone Cutter, Jan. 10, 2004, Stone Cutter, Website printout, 2 Pages.

* cited by examiner

*Primary Examiner*—Robert A. Rose

(57) ABSTRACT

A stone cutting system for efficiently cutting stones of various shapes and sizes. The stone cutting system includes a retaining unit having a plurality of troughs capable of retaining a plurality of stone members, and a cutting unit having a plurality of blades that are extendable within each of the troughs for cutting the stone members.

18 Claims, 9 Drawing Sheets

STONE CUTTING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to stone cutting devices and more specifically it relates to a stone cutting system for efficiently cutting stones of various shapes and sizes.

2. Description of the Related Art

Stone cutter devices have been in use by stone masons for years for cutting individual stones into a desired shape and size. Conventional stone cutters are typically hand-operated tools with a stone cutting blade that are only capable of cutting one stone at a time. Conventional stone cutters are typically utilized for cutting flat tile (e.g. ceramic, stone) and are not suitable for cutting a body of a stone into two or more segments.

U.S. Pat. No. 6,263,866 to Tsao teaches a conventional stone cutter that has a cutting stone that is designed solely for cutting a flat tile member. U.S. Pat. No. 4,520,880 to Saito teaches a stone cutter that divides a mass of stone into pieces such as large stones found at a rock quarry.

Another type of stone cutter is manufactured by VINCI STONE PRODUCTS, INC. under the trademark PORTA CUT. The PORTA CUT is a hydraulic stone cutter that utilizes a vertical blade pressed into the stone by a plurality of hydraulic cylinders thereby splitting the stone into a desired shape and size.

The prior art technology of stone cutting does not teach a system for efficiently cutting stones of various shapes and sizes. Conventional stone cutters typically require the stone to be precut into a desired shape (e.g. flat) and can only cut one stone at a time.

While these devices may be suitable for the particular purpose to which they address, they are not as suitable for efficiently cutting stones of various shapes and sizes. Conventional stone cutters are not as suitable for efficiently cutting stones of various shapes and sizes.

In these respects, the stone cutting system according to the present invention substantially departs from the conventional concepts and designs of the prior art, and in so doing provides an apparatus primarily developed for the purpose of efficiently cutting stones of various shapes and sizes.

BRIEF SUMMARY OF THE INVENTION

In view of the foregoing disadvantages inherent in the known types of stone cutting devices now present in the prior art, the present invention provides a new stone cutting system construction wherein the same can be utilized for efficiently cutting stones of various shapes and sizes.

The general purpose of the present invention, which will be described subsequently in greater detail, is to provide a new stone cutting system that has many of the advantages of the stone cutting devices mentioned heretofore and many novel features that result in a new stone cutting system which is not anticipated, rendered obvious, suggested, or even implied by any of the prior art stone cutting devices, either alone or in any combination thereof.

To attain this, the present invention generally comprises a retaining unit having a plurality of troughs capable of retaining a plurality of stone members, and a cutting unit having a plurality of blades that are extendable within each of the troughs for cutting the stone members.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a stone cutting system that will overcome the shortcomings of the prior art devices.

A second object is to provide a stone cutting system for efficiently cutting stones of various shapes and sizes.

Another object is to provide a stone cutting system that is capable of simultaneously cutting a plurality of stones.

An additional object is to provide a stone cutting system that is capable of cutting a stone into two or more pieces.

A further object is to provide a stone cutting system that is capable of cutting various types of stone material.

Another object is to provide a stone cutting system that is capable of cutting stones into various widths.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
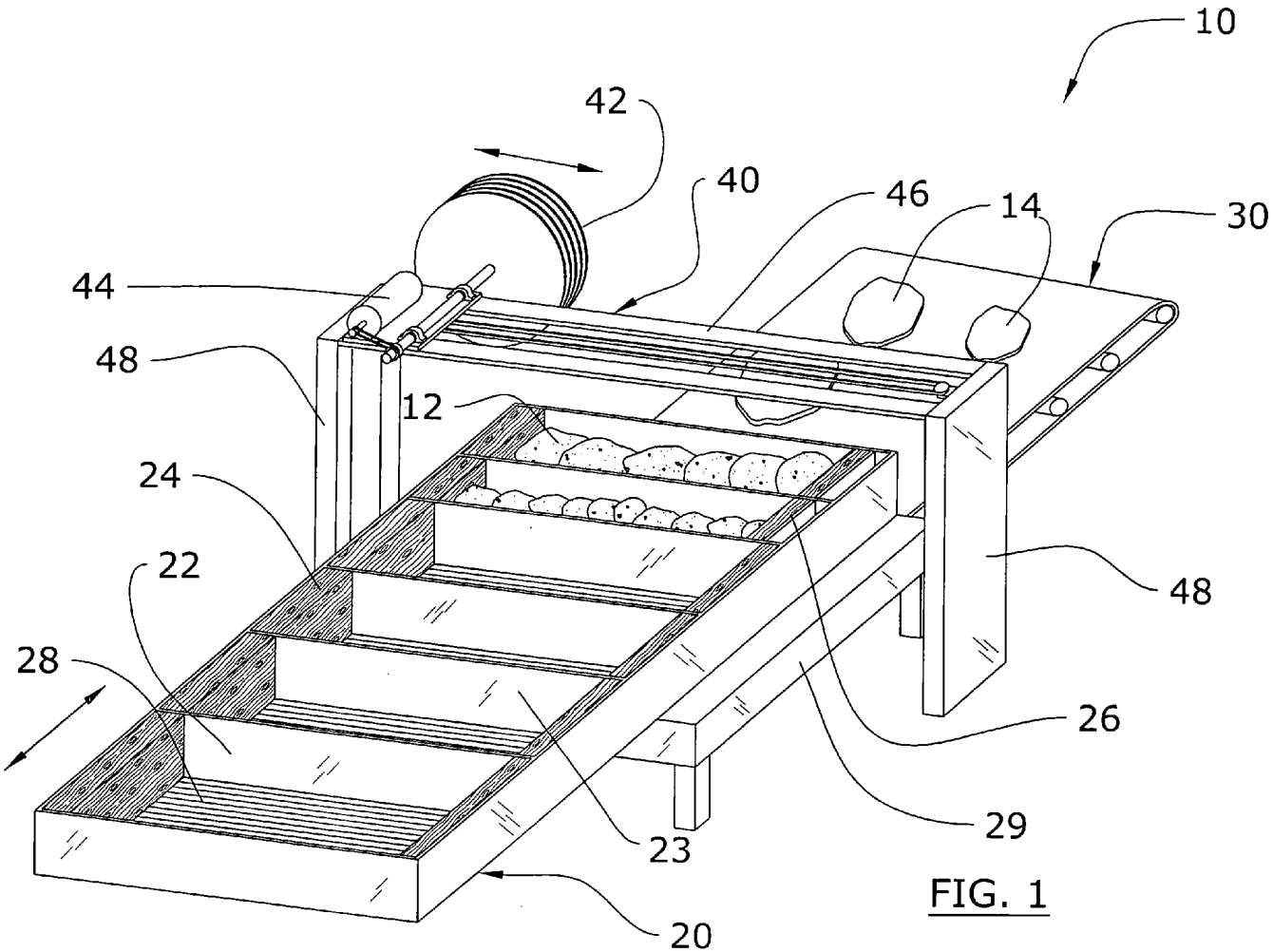
FIG. 1 is an upper perspective view of the present invention.

Turning now descriptively to the drawings, in which similar reference characters denote similar elements throughout the several views, FIGS. 1 through 9 illustrate a stone cutting system 10, which comprises a retaining unit 20 having a plurality of troughs 22 capable of retaining a plurality of stone members 12, and a cutting unit 40 having a plurality of blades 42 that are extendable within each of the troughs 22 for cutting the stone members 12.

B. Retaining Unit

Figure 9:
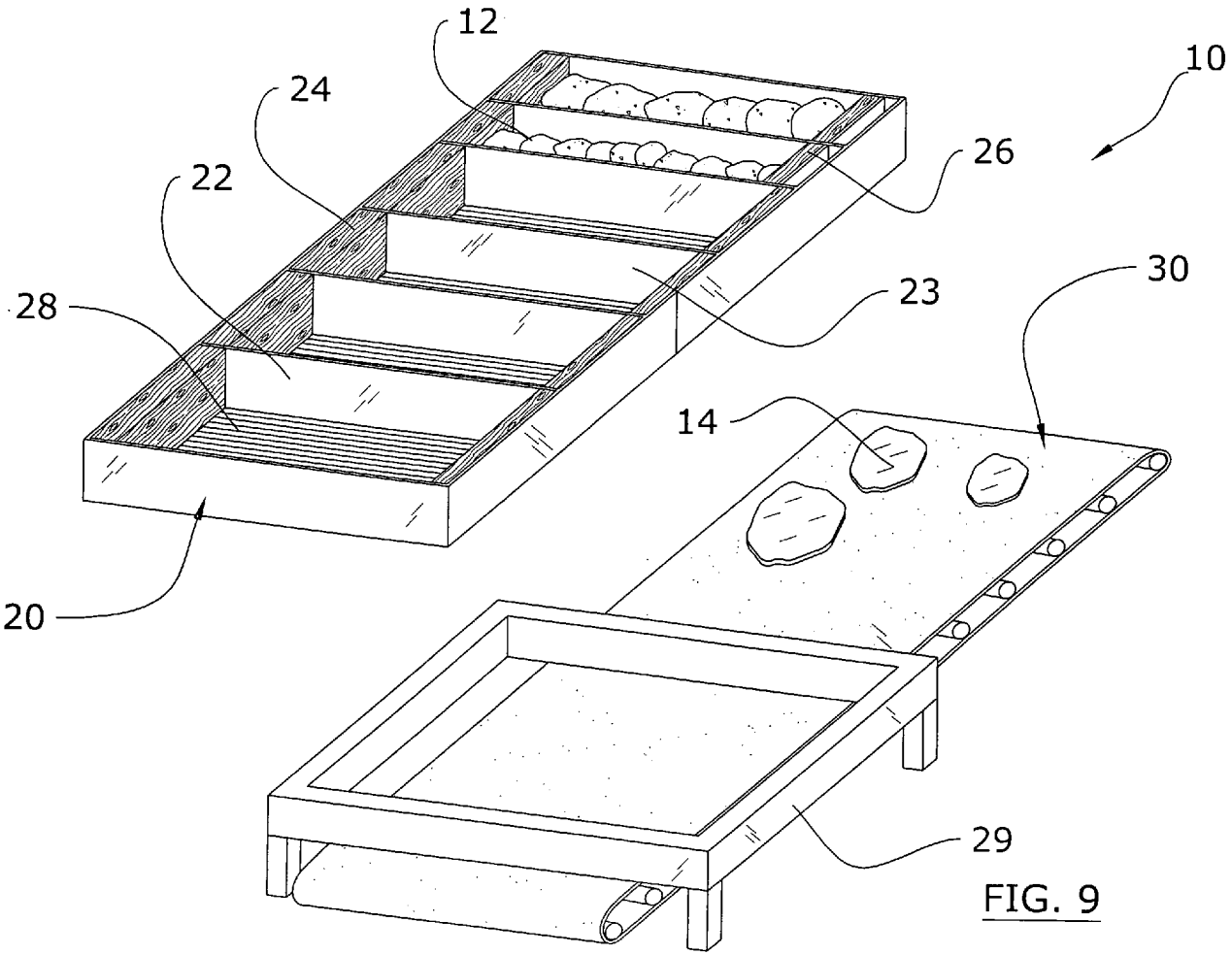
FIG. 9 is an exploded upper perspective view of the retaining unit with respect to the support stand and conveyor.

The retaining unit 20 has at least one trough 22 capable of receiving a plurality of naturally shaped stone members 12. As shown in FIGS. 1 and 9 of the drawings, the retaining unit 20 preferably has a plurality of troughs 22 substantially parallel to one another. The troughs 22 are preferably comprised of an elongate structure with a uniform width as further shown in FIGS. 1 and 9 of the drawings. The troughs 22 are preferably formed for non-movably receiving a plurality of stone members 12 in a longitudinal manner as shown in FIG. 1 of the drawings.

The troughs 22 are formed by one or more partition walls 23 that may be adjustable to allow for adjustment of the width of the troughs 22. The plurality of troughs 22 may have varying widths to accommodate various sizes of stone members 12.

Figure 7:
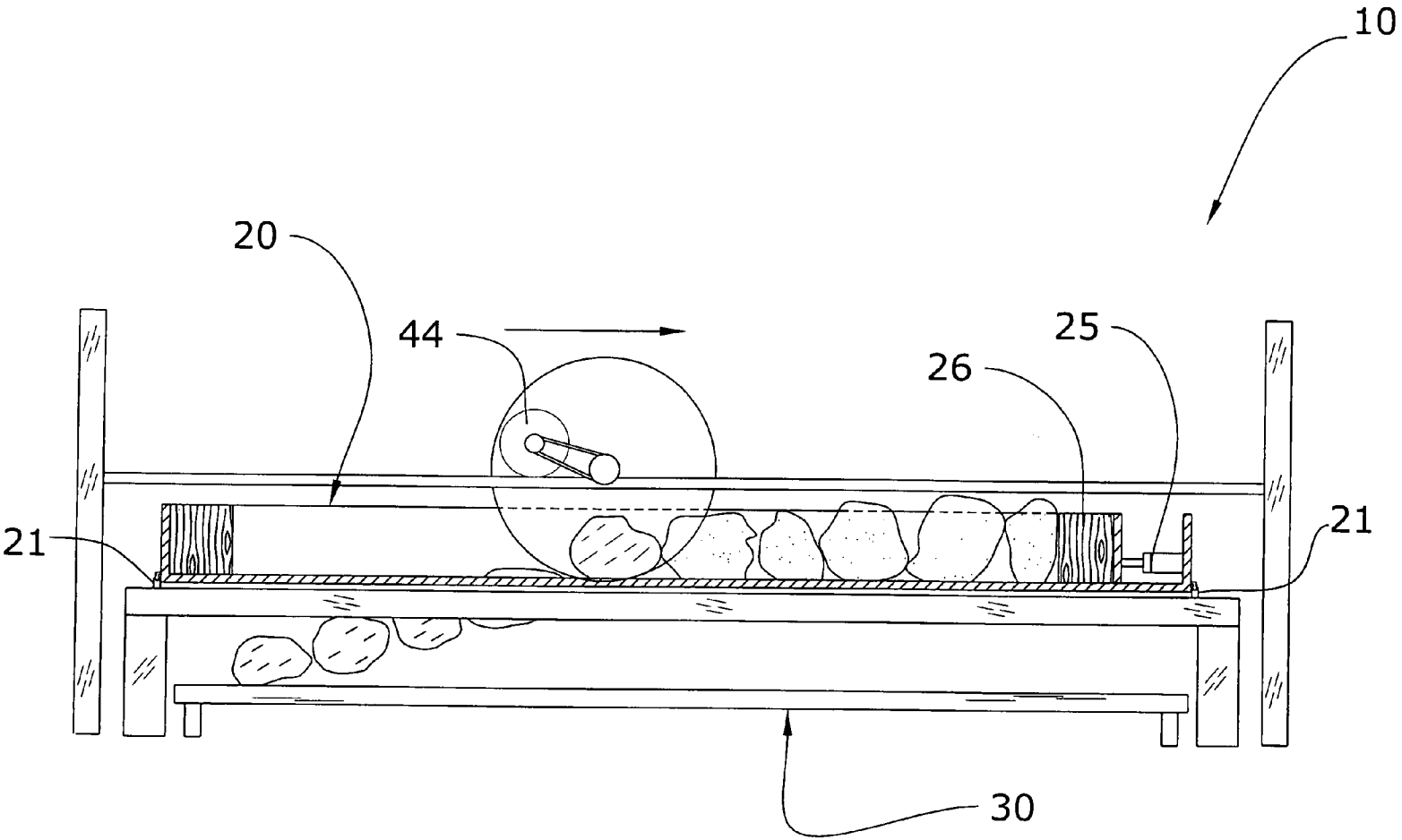
FIG. 7 is an end cutaway view of the blades cutting the stone members into stone pieces.

Each of the troughs 22 includes a floor 28 for supporting the stone members 12. The floor 28 preferably includes a plurality of slots that allow for the passing through of a plurality of cut stone pieces 14 as shown in FIGS. 1 and 7 of the drawings. The slots are sized to allow for proper support of the stone members 12 prior to cutting while allowing for the cut stone pieces 14 to freely pass through onto the conveyor unit 30. The plurality of slots are preferably substantially parallel to a longitudinal axis of the troughs 22 as shown in FIG. 1 of the drawings. Alternatively, the floor 28 may be movably attached (e.g. pivotal, removable, etc.) to the retaining unit 20 for allowing the passing through of a plurality of cut stone pieces 14.

Each of the troughs 22 preferably includes a compression member 26 at an end thereof that is capable of compressing a plurality of stone members 12 in a longitudinal manner as shown in FIGS. 1, 7 and 9 of the drawings. At least one actuator unit 25 is preferably attached to the compression member 26 and the retaining unit 20 for extending/retracting the compression member 26 as shown in FIG. 7 of the drawings. The actuator unit 25 may be comprised of an electrical actuator or hydraulic actuator. An end member 24 is preferably positioned opposite of the compression member 26 which may be comprised of a severable material such as wood for receiving a portion of the blades 42 during cutting.

The retaining unit 20 is preferably movably positioned with respect to the cutting unit 40 along a path substantially transverse to a cutting path of the cutting unit 40 as shown in FIGS. 1 through 6 of the drawings. One or more support rails 21 attached to a support stand 29 and to the retaining unit 20 allow for the retaining unit 20 to move horizontally with respect to the cutting unit 40 as shown in FIGS. 3 through 6 of the drawings. The retaining unit 20 may be manually manipulated or mechanically manipulated via an actuator or similar device.

C. Cutting Unit

The cutting unit 40 has at least one blade capable of cutting through a stone material (e.g. granite). The cutting unit 40 is preferably comprised of a gang saw structure wherein multiple blades 42 may be interchanged and spaced apart a desired distance for cutting stone members 12 of different sizes and for creating stone pieces 14 of different widths. The blades 42 are capable of being extended within the at least one of the troughs 22 for cutting a plurality of stone members 12 into a plurality of stone pieces 14 as shown in FIGS. 2 and 7 of the drawings.

Figure 2:
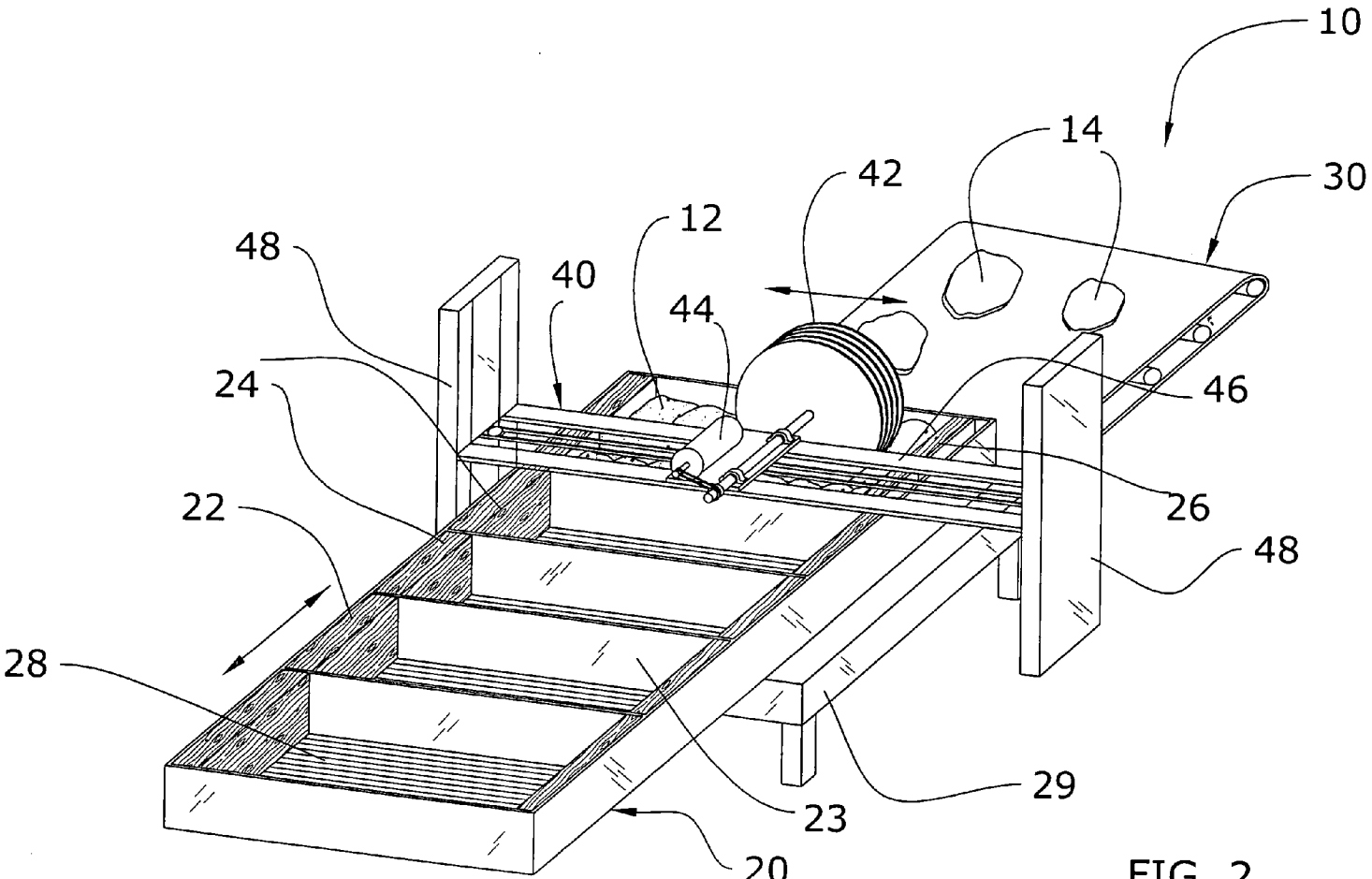
FIG. 2 is an upper perspective view of the present invention with the blades cutting the stone members within one of the troughs.

The cutting unit 40 is preferably movable in a vertical manner to allow for lowering of the cutting blades 42 into the troughs 22 of the retaining unit 20 as shown in FIGS. 1 and 2 of the drawings. The cutting unit 40 is also preferably movable in a horizontal manner substantially parallel to the at least one trough 22 for cutting the stone members 12.

Figure 8A:
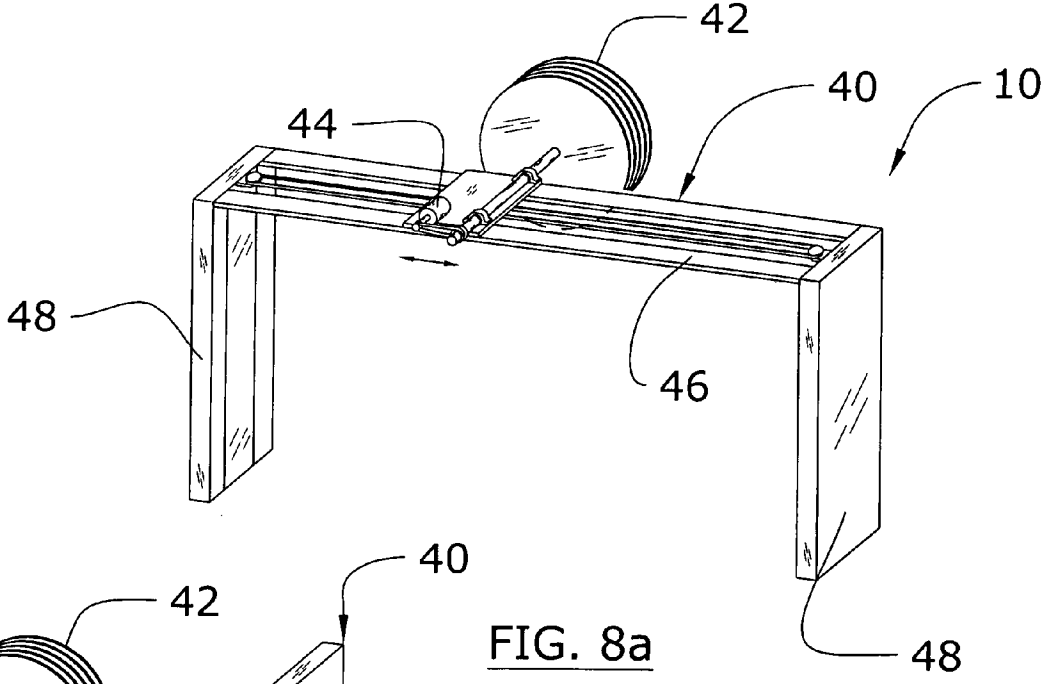
FIG. 8*a* is an upper perspective view of the cutting unit with the blades in the raised position.
Figure 8B:
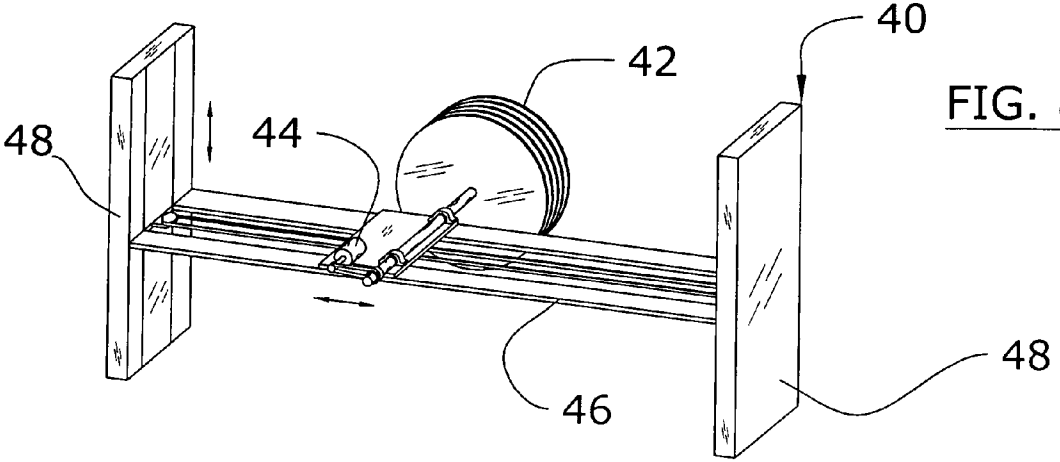
FIG. 8*b* is an upper perspective view of the cutting unit with the blades in the lowered position.

The cutting unit 40 may be comprised of a motor 44 mechanical attached to a shaft supporting the blades 42 mounted upon a platform as shown in FIGS. 8*a* and 8*b* of the drawings. The platform is slidably supported upon a support member 46 and is mechanically connected to a manipulation structure (e.g. cable, chain, etc.) for positioning the platform in a desired location along the support member 46.

A pair of opposing vertical supports 48 are attached to the opposing ends of the support member 46 for vertically supporting the support member 46 in an adjustable manner as shown in FIGS. 8*a* and 8*b* of the drawings. The support member 46 may be vertically adjusted with respect to the vertical supports 48 via a conventional lifting/lower structure such as an actuator or chain/cable structure.

D. Conveyor Unit

The conveyor unit 30 is preferably positioned beneath the retaining unit 20 for transferring a plurality of cut stone pieces 14 that fall through the floor 28 within the retaining unit 20. The conveyor unit 30 is preferably positioned beneath the support stand 29 as shown in FIGS. 1 through 7 of the drawings. The conveyor unit 30 may be comprised of any conventional conveyor structure.

E. Operation

In use, the user first adjusts the troughs 22 within the retaining unit 20 to their desired widths in order to accommodate the various sizes and shapes of stone members 12. Once the troughs 22 are organized, the user then positions the appropriate sized stone members 12 within the troughs 22 as shown in FIGS. 1 and 9 of the drawings. Once the troughs 22 are filled with the stone members 12 end-to-end in a longitudinal manner, the user then manipulates the compression member 26 within each of the troughs 22 to compress the stone members 12 together in a relatively tight manner. The user next determines the desired thickness of the stone pieces 14 to be cut and adds/removes the appropriate number of blades 42 from the cutting unit 40. The user may also adjust the spacing between the blades 42 to create stone pieces 14 having varying widths.

Figure 3:
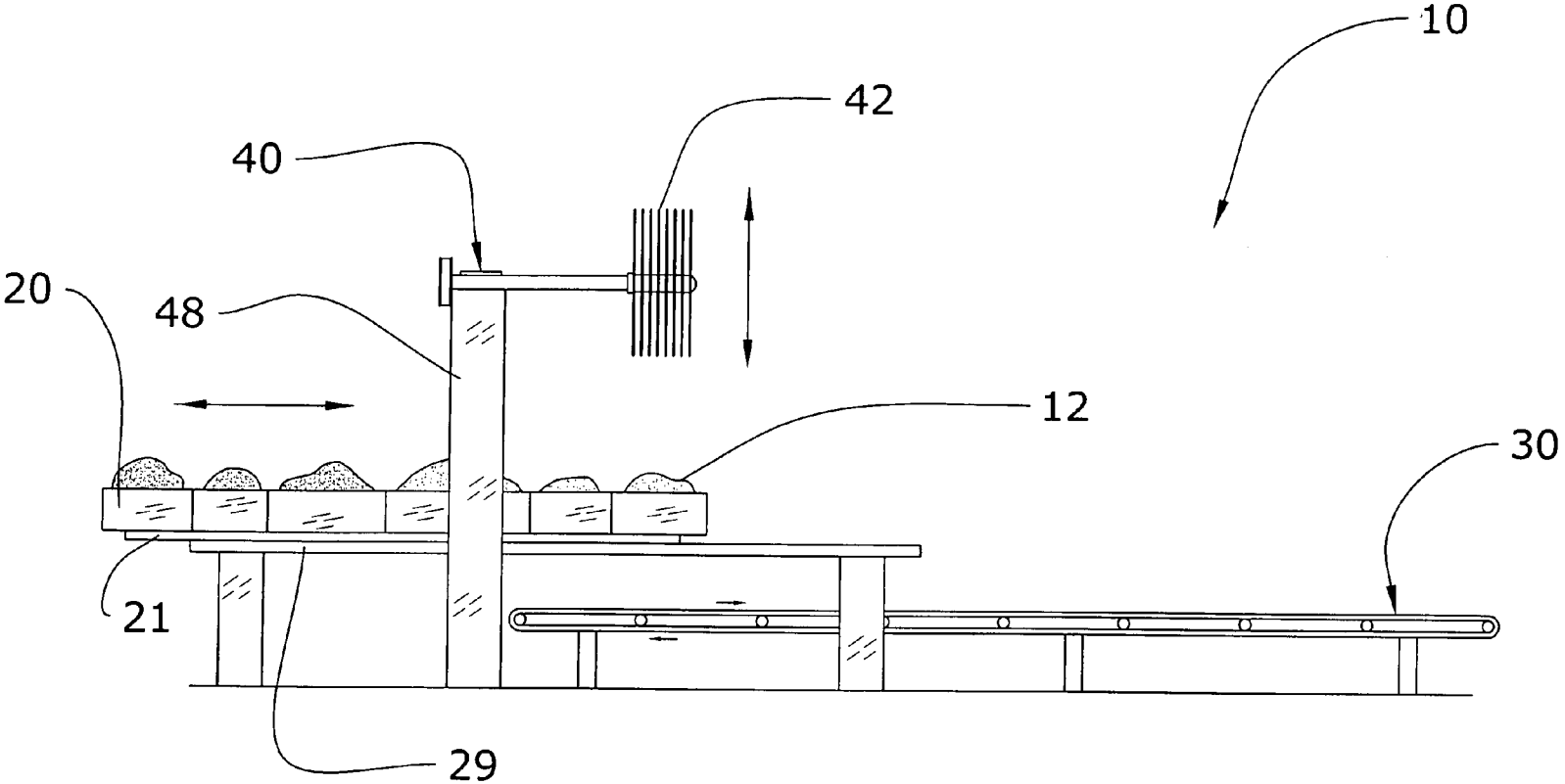
FIG. 3 is a side view of the present invention.
Figure 4:
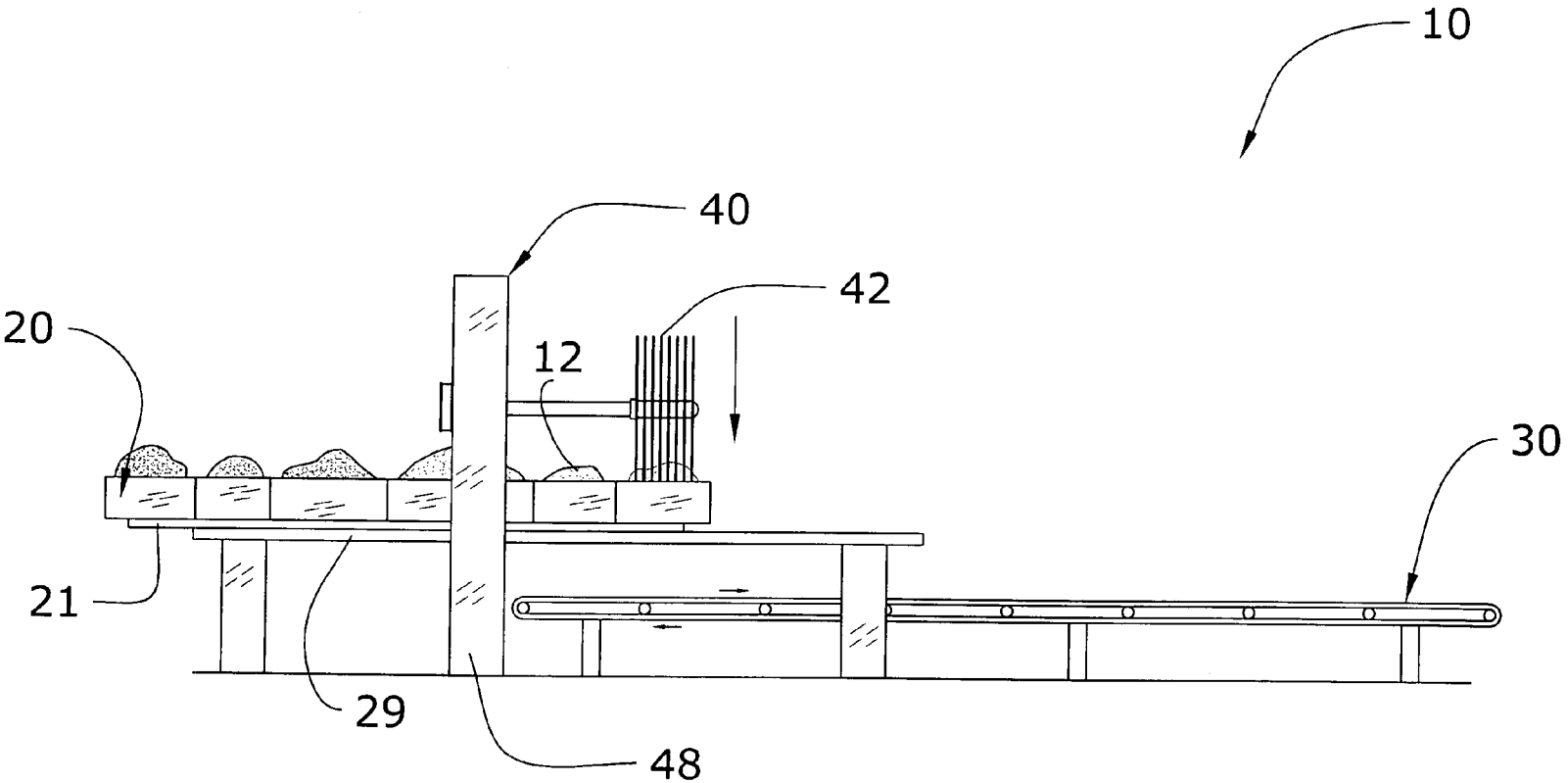
FIG. 4 is a side view of the present invention illustrating the blades cutting the stone members within a first trough.

Once the stone members 12 have been properly compressed together and the desired number of blades 42 have been installed, the user then operates the cutting unit 40 to rotate the blades 42 and then lowers the cutting unit 40 so that the blades 42 begin to cut the stone members 12 within the first trough 22 as shown in FIGS. 2 through 4 of the drawings. As the stone members 12 are cut into a plurality of stone pieces 14 (each having at least one flat surface), the stone pieces 14 fall through the slots within the floor 28 of the trough 22 as shown in FIG. 7 of the drawings. The cutting unit 40 moves longitudinally along the first trough 22 cutting the stone members 12 within the first trough 22 as further shown in FIG. 7 of the drawings. The cutting unit 40 is capable of sensing the hardness of the stone members 12 being cut and adjusts the movement speed accordingly.

Figure 5:
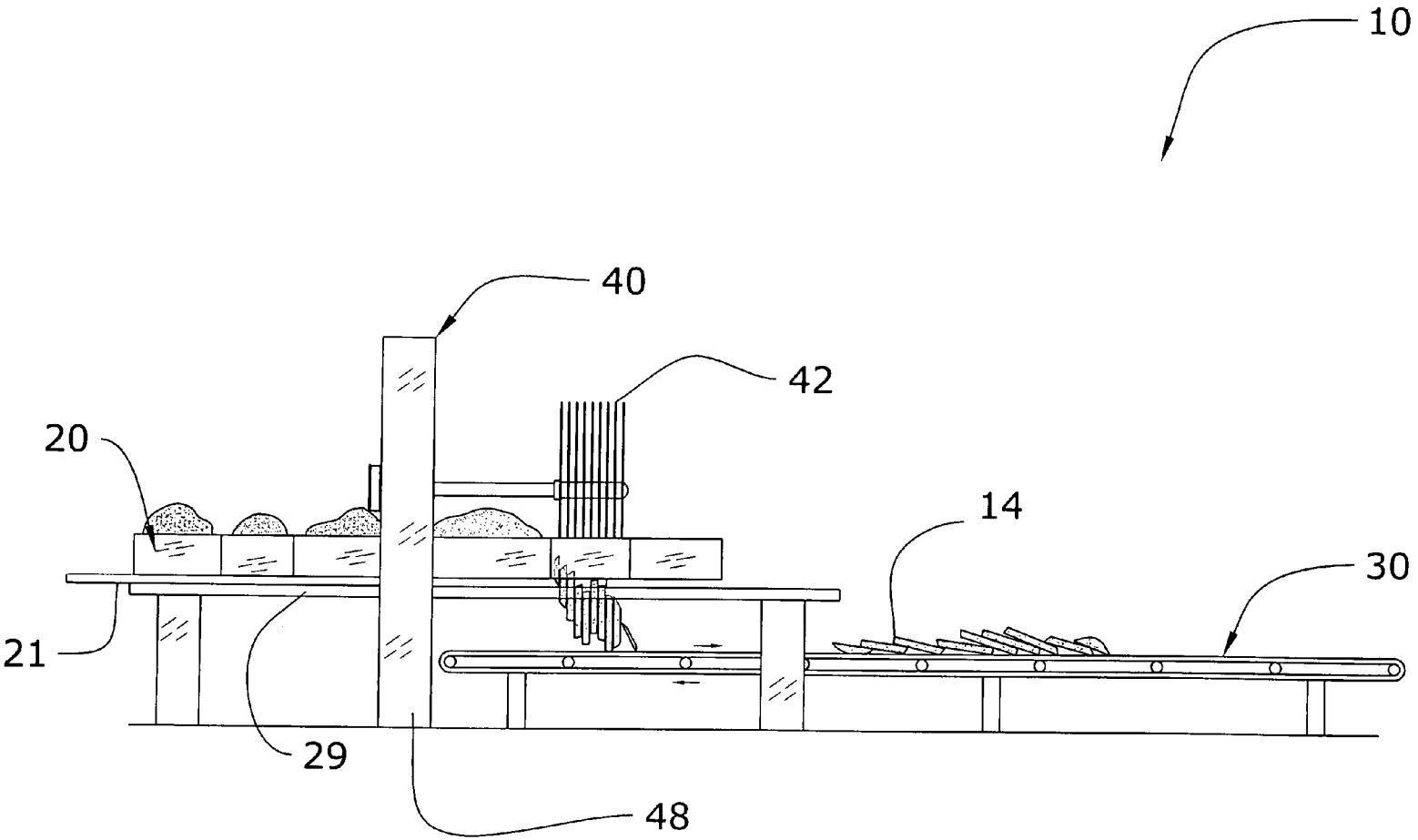
FIG. 5 is a side view of the present invention illustrating the blades cutting the stone members within a second trough.
Figure 6:
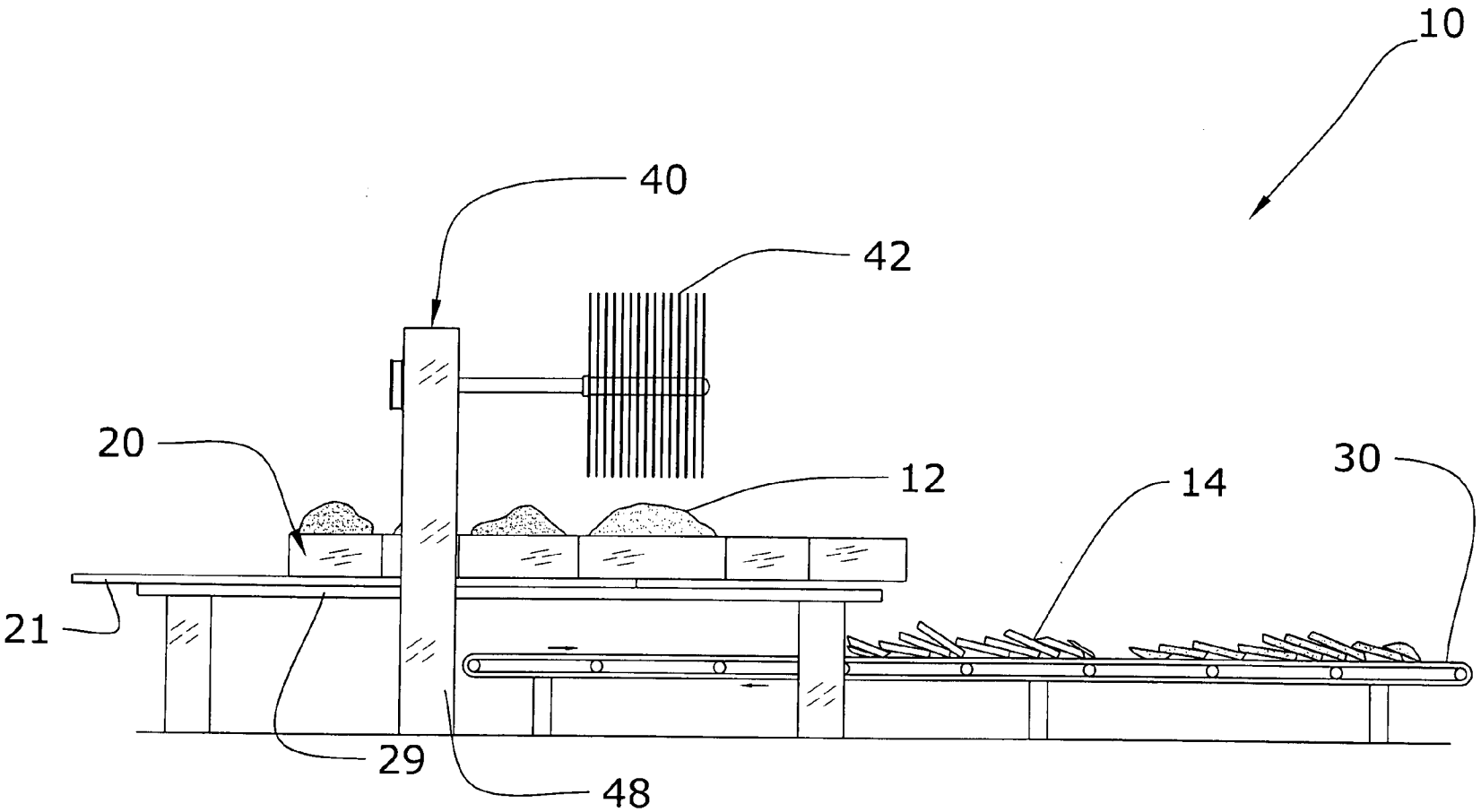
FIG. 6 is a side view of the blades positioned above a third trough within the retaining unit.

After the stone members 12 within the first trough 22 have been completely cut into stone pieces 14, the cutting unit 40 is then elevated and the retaining unit 20 is moved so that the second trough 22 is aligned with the blades 42 as shown in FIG. 5 of the drawings. The user may have to adjust the number/spacing of the blades 42 if the second trough 22 is a different width. The user then uses the cutting unit 40 to cut the stone members 12 contained within the second trough 22. The above-stated process continues until all of the stone members 12 within the retaining unit 20 have been cut into the desired stone pieces 14. The cut stone pieces 14 may then be further processed (e.g. polishing, etching, etc.).

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

The invention claimed is:

1. A stone cutting system, comprising:

a retaining unit having at least one trough for receiving a plurality of stone members, wherein said at least one trough includes a compression member that is capable of compressing a plurality of stone members in a longitudinal manner; and a cutting unit having at least one blade, wherein said at least one blade is capable of being extended within said at least one trough for cutting a plurality of stone members into a plurality of stone pieces;

wherein said retaining unit is movably positioned with respect to said cutting unit along a path substantially transverse to a cutting path of said cutting unit.

2. The stone cutting system of claim 1, wherein said at least one trough is comprised of an elongate structure.

3. The stone cutting system of claim 1, wherein said at least one trough has a uniform width.

4. The stone cutting system of claim 1, wherein said at least one trough has an adjustable width.

5. The stone cutting system of claim 1, wherein said at least one trough has a first end and an opposing second end.

6. The stone cutting system of claim 1, wherein said compression member is positioned within an end of said at least one trough.

7. The stone cutting system of claim 1, including at least one actuator unit attached to said compression member.

8. The stone cutting system of claim 1, wherein said at least one trough includes a floor.

9. The stone cutting system of claim 8, wherein said floor includes a plurality of slots that allow for the passing through of a plurality of cut stone pieces.

10. The stone cutting system of claim 9, wherein said plurality of slots are substantially parallel to a longitudinal axis of said at least one trough.

11. The stone cutting system of claim 8, wherein said floor is movably attached to said retaining unit for allowing the passing through of a plurality of cut stone pieces.

12. The stone cutting system of claim 1, including a conveyor unit positioned beneath said retaining unit for transferring a plurality of cut stone pieces.

13. The stone cutting system of claim 1, wherein said cutting unit is comprised of a gang saw.

14. The stone cutting system of claim 1, wherein cutting unit is movable in a vertical manner.

15. The stone cutting system of claim 1, wherein said cutting unit is movable in a horizontal manner substantially parallel to said at least one trough.

16. A stone cutting system, comprising:

a retaining unit having at least one trough for receiving a plurality of stone members;

wherein said at least one trough includes a floor, wherein said floor includes a plurality of slots that allow for the passing through of a plurality of cut stone pieces; and a cutting unit having at least one blade, wherein said at least one blade is capable of being extended within said at least one trough for cutting a plurality of stone members into a plurality of stone pieces.

17. The stone cutting system of claim 16, wherein said plurality of slots are substantially parallel to a longitudinal axis of said at least one trough.

18. A stone cutting system, comprising:

a retaining unit having at least one trough for receiving a plurality of stone members, wherein said at least one trough includes a compression member that is capable of compressing a plurality of stone members in a longitudinal manner;

a cutting unit having at least one blade, wherein said at least one blade is capable of being extended within said at least one trough for cutting a plurality of stone members into a plurality of stone pieces; and a conveyor unit positioned beneath said retaining unit for transferring a plurality of cut stone pieces.

* * * * *